US006722843B2

(12) United States Patent
Mensch

(10) Patent No.: US 6,722,843 B2
(45) Date of Patent: Apr. 20, 2004

(54) MATERIAL HANDLING APPARATUS

(76) Inventor: Donald L. Mensch, 2721 Bauer Rd., Jenison, MI (US) 49428

( * ) Notice: Subject to any disclaimer, the term of this patent is extended or adjusted under 35 U.S.C. 154(b) by 28 days.

(21) Appl. No.: 10/041,928

(22) Filed: Jan. 7, 2002

(65) Prior Publication Data

US 2003/0129050 A1 Jul. 10, 2003

(51) Int. Cl.[7] ..... B66C 1/00
(52) U.S. Cl. ..... 414/740; 414/729; 294/104
(58) Field of Search ..... 414/729, 621, 414/622, 740; 294/88, 104

(56) References Cited

U.S. PATENT DOCUMENTS

| | | | | |
|---|---|---|---|---|
| 2,870,925 A | | 1/1959 | Bernad et al. | |
| 3,148,787 A | * | 9/1964 | Clark et al. | 414/740 |
| 3,177,029 A | * | 4/1965 | Larson | 294/88 |
| 3,409,157 A | | 11/1968 | Lull | |
| 3,477,601 A | | 11/1969 | Gardner et al. | |
| 3,508,676 A | | 4/1970 | Petersson | |
| 3,817,567 A | | 6/1974 | Lull | |
| 4,030,626 A | | 6/1977 | Durham | |
| 4,155,473 A | | 5/1979 | Holopainen | |
| 4,266,819 A | | 5/1981 | Pemberton | |
| 4,285,628 A | | 8/1981 | Jankowski | |
| 4,295,771 A | | 10/1981 | Mehesan, Jr. | |
| 4,403,906 A | | 9/1983 | Holopainen | |
| 4,493,604 A | | 1/1985 | Walker | |
| 4,519,739 A | * | 5/1985 | Risch | 414/724 |
| 4,529,239 A | | 7/1985 | Ogawa | |
| 4,659,277 A | | 4/1987 | Widener | |
| 5,073,080 A | | 12/1991 | Blum | |
| 5,184,934 A | | 2/1993 | Gallo | |
| 5,263,811 A | | 11/1993 | Teffer | |
| 5,328,223 A | | 7/1994 | Maggio | |
| 5,509,774 A | | 4/1996 | Yoo | |
| 5,518,359 A | | 5/1996 | Pratt | |
| 5,564,885 A | | 10/1996 | Staben, Jr. | |
| 6,109,859 A | | 8/2000 | Domann | |
| 6,267,547 B1 | | 7/2001 | Lund | |
| 6,287,072 B1 | | 9/2001 | Wasilas | |

* cited by examiner

*Primary Examiner*—Donald W. Underwood
(74) *Attorney, Agent, or Firm*—Price Heneveld Cooper Dewitt & Litton

(57) ABSTRACT

A material handling apparatus includes a frame attachable to a front-end loader vehicle. A tine is attached to the frame, and a top clamp arm is pivoted to the frame and extends over the tine. The clamp arm is movable between a closed position where teeth on a forward lower surface extend generally parallel the tine for holding objects on the front portion, and a partially closed position where teeth on the rearward lower surface are located to hold objects on the rear portion of the tine. The rearward lower surface is upwardly angled from the forward lower surface so that the rear teeth do not interfere with holding a primary object on the front teeth even with secondary objects under the rearward lower surface. The clamp arm has a width and defines a space for receiving the tine, thus providing improved clamping ability.

16 Claims, 5 Drawing Sheets

MATERIAL HANDLING APPARATUS

BACKGROUND

The present invention relates to material handling apparatus for outdoor use, such as in landscaping, and more particularly relates to an apparatus attachable to a front-end loader, the apparatus having a thin tine positioned to slip under and lift objects and a clamp for holding the objects on the tine.

Landscaping companies often need power equipment to handle heavy and/or bulky objects. The power equipment can both reduce the amount of manual labor and also prevent injury to workers. However, the equipment must be highly adaptable to a wide variety of needs and must be durable in order for the landscaping companies to remain competitive. Further, the equipment must not be expensive, complex, or difficult to use.

It is preferable that the apparatus be adapted for use with existing powered landscaping equipment, such as on a front-end loader or on a fork truck. In such case, it is important that the apparatus be easily removable from the front-end loader, yet be secure and stable when attached to the front-end loader and in use.

In particular, an apparatus is desired that is able to handle rocks, tree trunks and limbs, piles of organic and non-organic materials, railroad/landscaping ties, and a variety of other landscaping materials that must be hauled and moved around on uneven ground. It is preferable that the apparatus be able to hold onto the objects with some level of sureness, even where objects are non-uniform and not well-balanced, and where the objects may shift or bend while being carried. Still further, the apparatus must be able to slid under the objects to be moved, even when the objects are partially buried into the ground.

Accordingly, an apparatus is desired solving the aforementioned problems and having the aforementioned advantages.

SUMMARY OF THE PRESENT INVENTION

In one aspect of the present invention, a material handling apparatus includes a frame adapted for attachment to a front-end loader vehicle. A tine is attached to the frame, and a top clamp arm is pivoted to the frame. The top clamp arm is elongated and extends forwardly over the tine. The clamp arm has a lower surface defining a plurality of teeth located along at least half of a length of the top clamp arm.

In another aspect of the present invention, a material handling apparatus includes a frame adapted for attachment to a front-end loader vehicle. A tine is attached to the frame, and a top clamp arm is pivoted to the frame. The top clamp arm is elongated and has a forward lower surface extending over a front portion of the tine and a rearward lower surface extending over a rear portion of the tine. The clamp arm is movable between a fully closed position where the forward lower surface extends generally parallel the tine and is located to hold objects on the front portion of the tine, and is movable to a partially closed position where the rearward lower surface extends generally parallel the tine and is located to hold objects on the rear portion of the tine.

In another aspect of the present invention, a material handling apparatus includes a frame adapted for attachment to a front-end loader vehicle. A tine includes a base attached to the frame, and a top clamp arm is pivoted to the frame. The top clamp arm is elongated and has a cross section including side walls and a cross wall connecting the side walls, the side walls defining a space to receive the tine.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
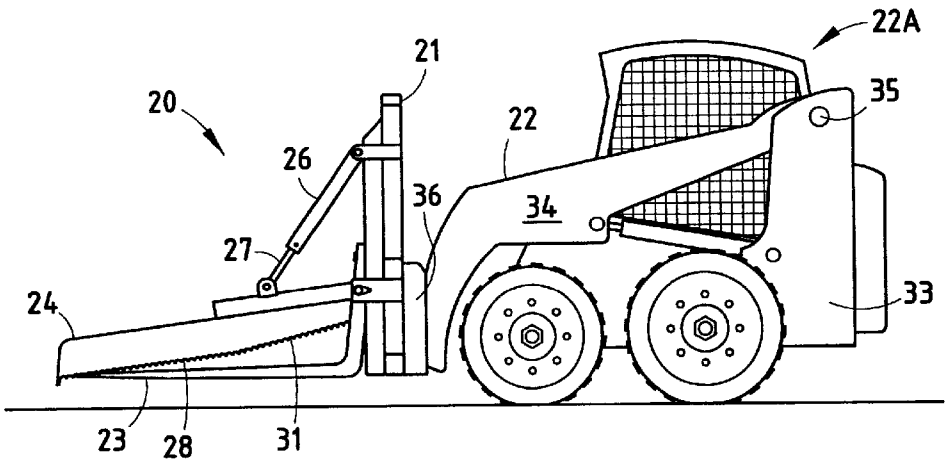
FIG. 1 is a side view of a material handling apparatus supported on a front-end loader vehicle.
Figure 2:
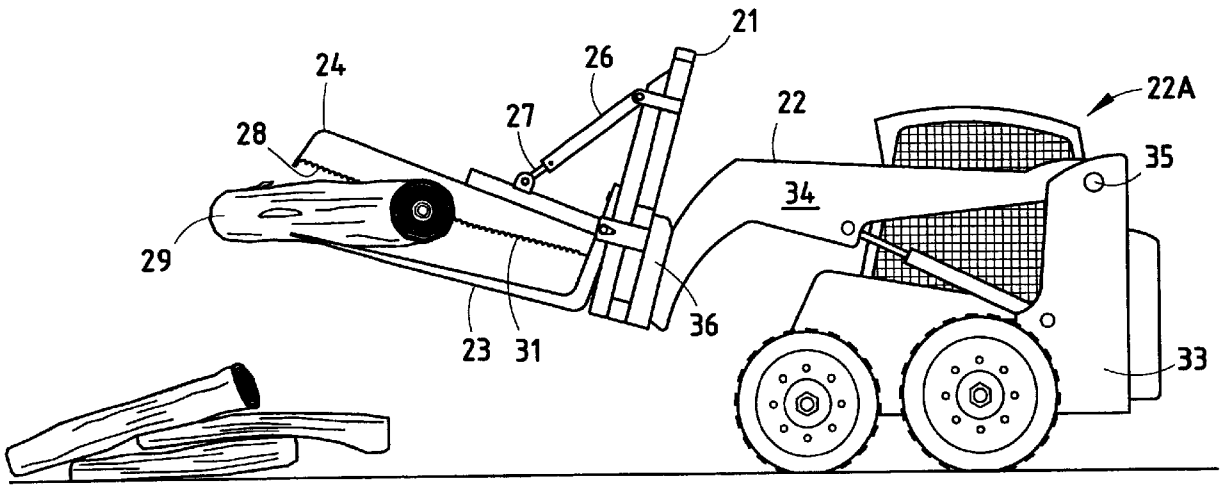
FIG. 2 is a side view of the material handling apparatus of FIG. 1 lifting a log.
Figure 3:
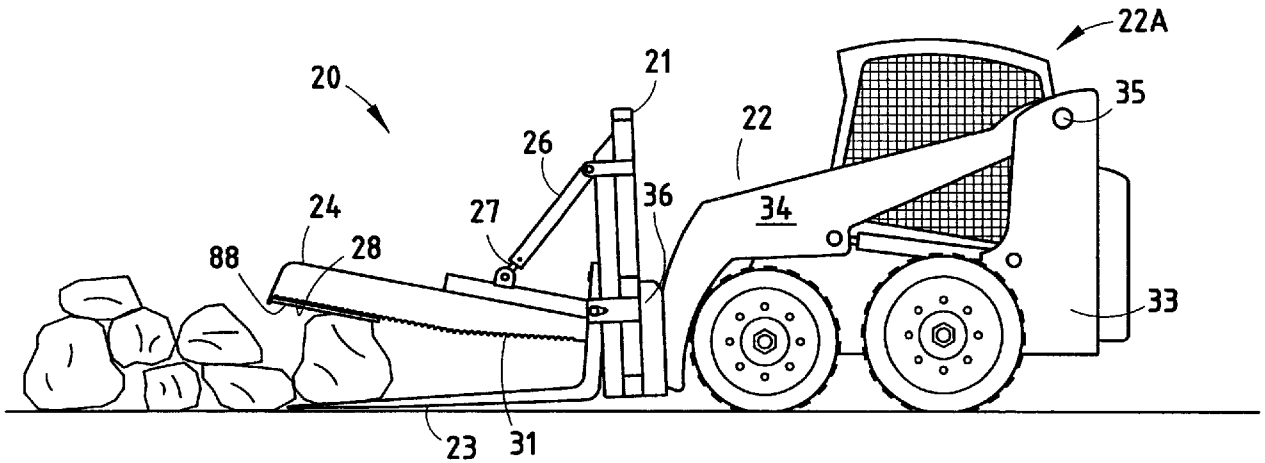
FIGS. 3–4 are side views of the material handling apparatus of FIG. 1 lifting a stone, FIG. 3 showing a fork of the apparatus sliding under the stone, and FIG. 4 showing the stone in a lifted position.

A material handling apparatus 20 (FIG. 1) includes a frame 21 adapted for operative attachment to a hydraulically-operated lift 22 on a front-end loader vehicle 22A. The apparatus 20 includes a tine 23 fixed to the frame 21 and a top clamp arm 24 pivoted to the frame 21 for vertical clamping movement onto the tine 23 by action of hydraulic cylinders 26 and extendable rods 27. The clamp arm 24 is movable between a fully closed position (FIG. 1) where front teeth 28 on its forward lower surface extend generally parallel the tine 23 for holding objects 29 on a front half portion, and is movable to a partially-closed/partially-open position (FIG. 2) where rear teeth 31 on the rearward lower surface are located parallel the tine 23. The rearward lower surface is upwardly angled from the forward lower surface so that when the clamp arm 24 is closed, the rear teeth 31 do not interfere with holding the primary object 29 on the front teeth 28 even with secondary objects under the rearward lower surface.

It is noted that a variety of different front-end loader vehicles for use in landscaping are available, and the illustrated vehicle 22A is only one such vehicle. One well-known type of such vehicle is known as a BOBCAT™. These vehicles typically include a body 33, and a pair of arms 34 pivoted to the body 33 at rear location such as location 35. The arms 34 extend forward of the vehicle 22A, and are connected together with a frame member 36 for stability. Standardized connectors (not specifically shown) are provided on the frame member 36 for releasable connection to working accessories, such as to a bucket for scooping and moving dirt, to a scraper for scraping a ground area, and the like. The standardized connectors can be three-point, four-point, or any standardized connection arrangement.

The frame 21 (FIG. 5) of the present apparatus 20 includes a rear subframe 37 and a front subframe 52 attached together for optimal strength. The rear subframe 37 has rearward-facing top and bottom connectors 38 and 39 shaped for secure attachment to the standardized connectors on the front-end loader vehicle 22A. The illustrated top connector 38 defines a wide downwardly-facing throat with right and left portions 40 and 41, and the illustrated bottom connector 39 defines a pair of laterally spaced apertured flanges 42 and 43. The connectors 38 and 39 are reinforced by side reinforcements 44 and 45 that extend vertically between them. The rear subframe 37 includes top and bottom horizontal frame tube sections 46 and 47 welded to vertical frame tube sections 48–51. The front subframe 52 includes a pair of vertical tube sections 53 and 54 secured to the rear subframe 37. An inverted U-shaped stiffener is attached to a top of the front subframe 52 above the rear subframe 37, and includes upright tube sections 55 and 56 and a transverse tube section 57. A bottom tube section 59 further stiffens the front subframe 52.

Many vehicles 22A have the ability to pivot frame member 36 separate from the arms 34. For example, this feature allows them to manipulate a bucket to better dig into the ground to scoop up dirt and also to dump the bucket from a raised position. That same feature is often desirable in the present apparatus 20 for optimal use. Where the vehicle 22A does not have that capability, it is contemplated that the front subframe 52 will be pivoted to the rear subframe at its bottom, such as by providing forwardly-extending side plates (not shown) on rear subframe 37 that pivotally engage the tube section 59. In such case, the front subframe 52 would be operably supported at its top, such as by a length-adjustable mechanical connector or by a hydraulic cylinder and rod at location 60. This would allow an angle of the tine 23 to be adjusted by an operator of the front-end loader vehicle, adding an additional degree of freedom, even though a lower cost vehicle 22A was being used.

Figure 6:
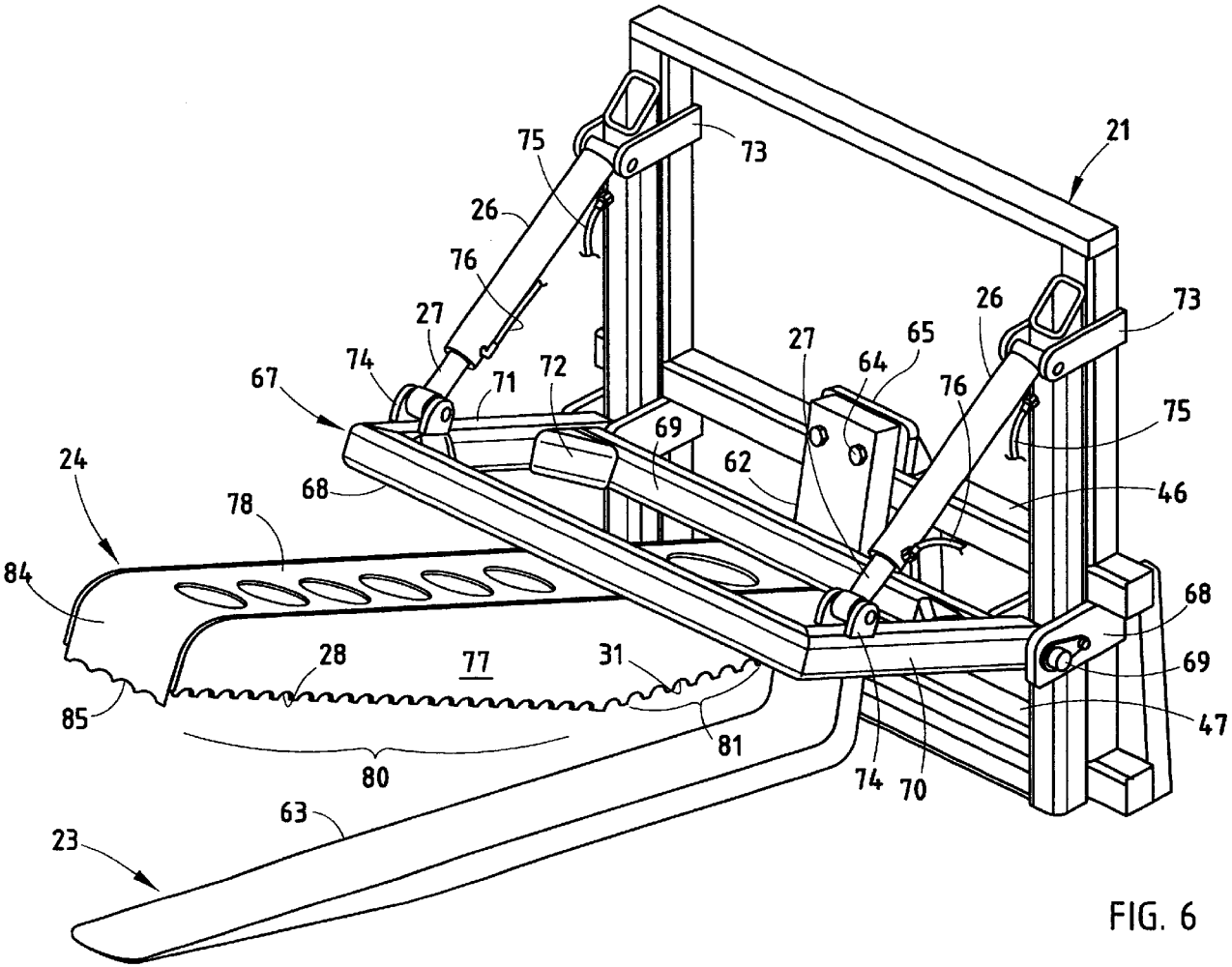
Figure 7:
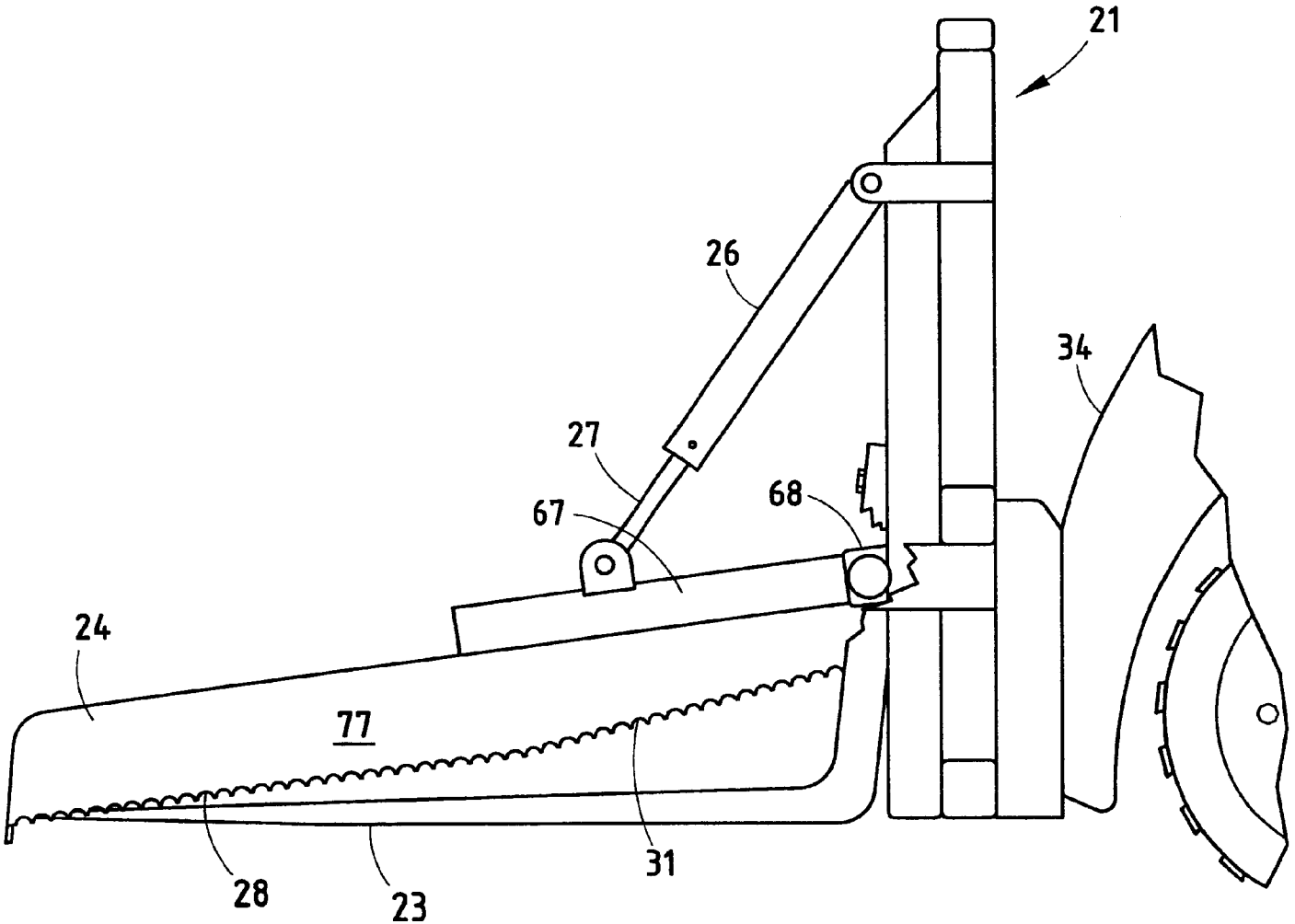

The tine 23 (FIG. 6) is L-shaped in side view, and includes a vertical leg 62 and a horizontal leg 63. Leg 63 can be selected to be any desired length, but it has been found that a length of about 5' to 8', or more preferably about 6', is often optimal. The tine 23 has a constant thickness along vertical leg 62 and a rear portion of the horizontal leg 63. A front portion of the horizontal leg 63 tapers to a relatively sharp blade-like front edge, allowing it to slip under a rock that is partially buried in the ground. A top of the vertical leg 62 is attached by bolts 64 or a strap to a bracket 65 on the top frame tube section 46, and a bottom of the vertical leg 62 abuts the bottom frame tube section 47. The bottom of leg 62 is held in place on bottom frame tube section 47 by bolts (i.e. similar to bolts 64) or by a non-invasive U-shaped strap wrapped around the leg 62 and clamped to tube section 47. Leg 62 extends downwardly to a location slightly below a bottom surface of the frame 21, which positions the horizontal leg 63 horizontally and at ground level when the vehicle arms 33 are at a lowered position. If desired, the leg 63 can be shimmed to be at a slightly downwardly angled position when the vehicle arms 33 are in their lowered position, so that the tine 23 is oriented to and has the capability of digging into the ground to pick up a load.

Clamp arm 24 (FIG. 6) is welded to a clamp subframe 67 pivoted to the frame 21 by side plates 68 for pivotal movement about horizontal pivot 69. Preferably, the pivot 69 is located above the horizontal leg 63 of the tine 23, such that the rear portion of the clamp arm 24 maintains a space above the rear portion of the leg 63. This prevents secondary material from bunching up on a rear portion of the leg 63 in a manner that would prevent the clamp arm 24 from clamping at its front-end onto the leg 63. The subframe 67 includes front, rear and side tube sections 68–71, and reinforcement gussets 72 at each corner. One of the hydraulic cylinders 26 is connected to a top of the frame 21 by pivot brackets 73, and the associated extendable rod 27 is attached to a front of the subframe 67 by pivot brackets 74. Hydraulic lines 75 and 76 are extended from the front and rear of the cylinders 26 to the hydraulic system of the front-end loader vehicle 22A.

Figure 4:
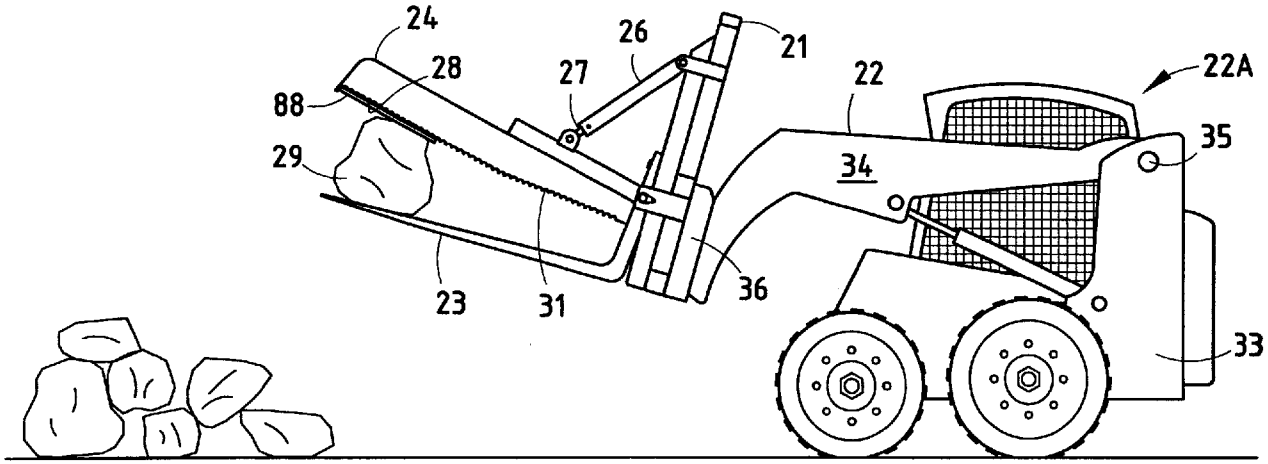

The clamp arm 24 (FIG. 6) includes a pair of parallel side walls 77 and a transverse top wall 78 forming an inverted U-shaped cross section. The side walls 77 are spaced apart about equal to but slightly greater than a width of the tine 23, thus giving the clamp arm 24 the ability to fit over and receive the tine 23. Further, the width of the clamp arm 24 in combination with the tine 23 provide the ability to give substantial torsional support to objects 29 on the tine 23. This can be especially useful if the objects 29 are not totally balanced or are flexible and can shift (for example, see the log in FIG. 1) and useful if the objects are heavy and relatively "tall" (see the stone in FIG. 4). The top wall 78 includes a plurality of apertures along its length to reduce weight. The side walls 77 have the teeth 28/31 formed along their bottom edge to improve the gripping action of the clamp arm 24 when it is brought close to the tine 23. The front half 80 of the lower edge of the side walls 77 extends approximately parallel the horizontal leg 63 of the tine 23 when the clamp arm 24 is in a fully closed position. The rear half 81 of the lower edge of the side walls 77 is at an angle to the front half, such that the rear half 81 does not prevent closure of the clamp arm 24 on a primary object even if there is secondary material under the rear half 81. At the same time, the teeth 31 on the rear half 81 permit the rear half to engage and grip material for secure handling close to the frame 21.

Figure 5:
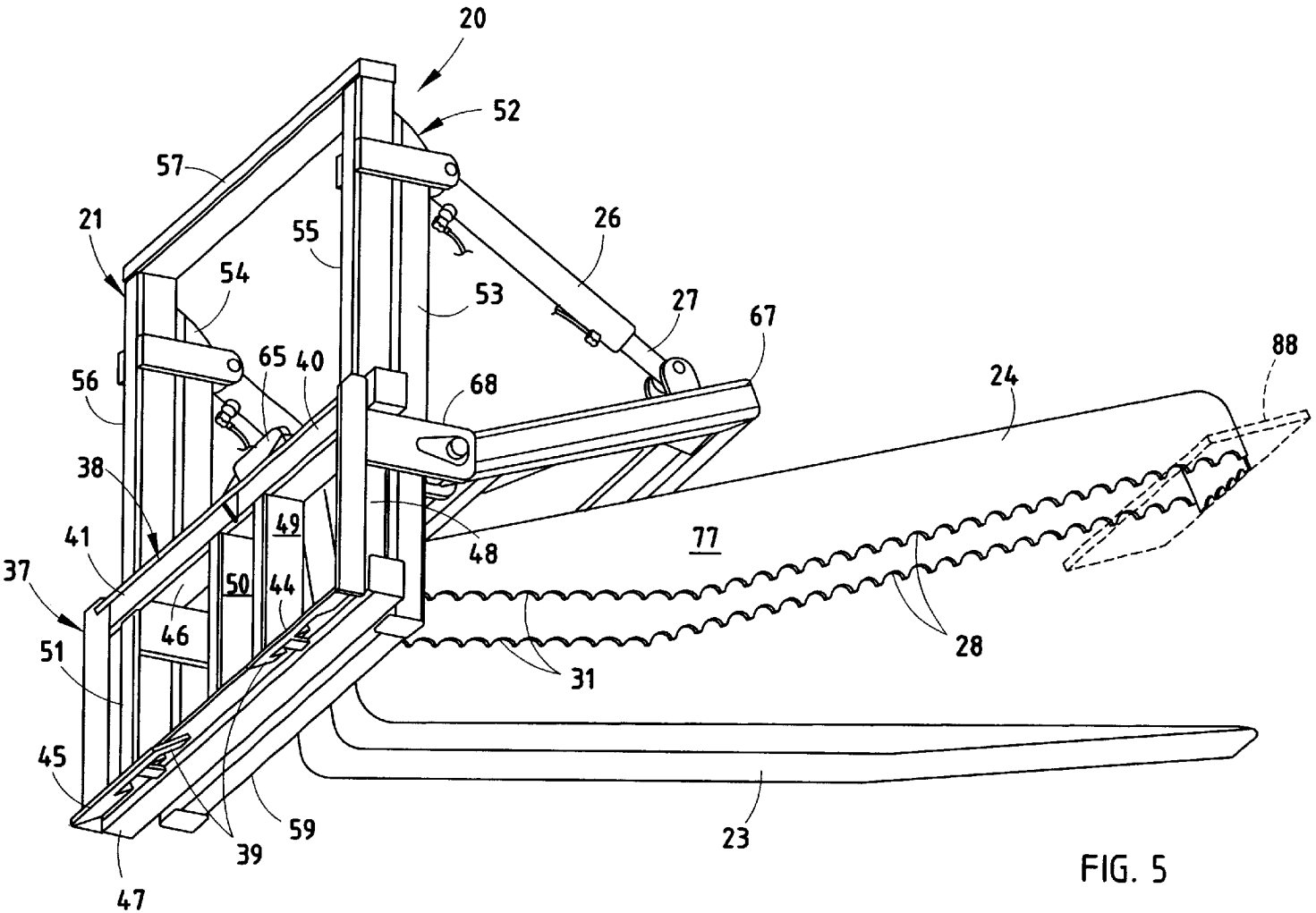
FIGS. 5–7 are rear perspective, front perspective, and side views of the apparatus of FIG. 1.

A front plate 84 (FIG. 6) is attached to a front-end of the clamp arm 24, and forms a hook-like beak configured to sharply engage and retain an object on the tine. The illustrated front plate 84 includes teeth 85 similar to the teeth 79. It is contemplated that the front plate 84 could also include a pointed tip or other optimal shape chosen for particular applications, if desired. FIG. 5 illustrates a rectangular rubber pad 88 (see dashed lines in FIG. 5) having a rough bottom surface with down fingers shaped to engage and retain a stone.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. A material handling apparatus comprising:

a mainframe adapted for attachment to a front-end loader vehicle:

a tine attached to the frame;

a top clamp arm pivoted to the frame, the top clamp arm being elongated and extending forwardly over the tine, the clamp arm having a lower surface defining a plurality of teeth located along at least half of a length of the top clamp arm; and a subframe supporting the clamp arm, the subframe being at least double a width of the clamp arm and pivoted to the main frame at pivots that are spaced apart at least double the width of the clamp arm.

2. A material handling apparatus comprising:

a frame adapted for attachment to a front-end loader vehicle;

a tine attached to the frame; and a top clamp arm pivoted to the frame, the top clamp arm being elongated and having a forward lower surface extending over a front portion of the tine and a rearward lower surface extending over a rear portion of the tine, the clamp arm being movable between a fully closed position where the forward lower surface extends generally parallel the tine and is located to hold objects on the front portion of the tine, and being movable to a partially closed position where the rearward lower surface extends generally parallel the tine and is located to hold objects on the rear portion of the tine.

3. The apparatus defined in claim 2, including teeth on the forward lower surface.

4. The apparatus defined in claim 2, wherein the top clamp arm includes a tip and includes at least one tooth on the tip.

5. The apparatus defined in claim 2, wherein the clamp arm includes a pair of horizontally-spaced parallel side walls.

6. The apparatus defined in claim 2, wherein the clamp arm defines a downwardly-open space sufficient to receive the tine.

7. The apparatus defined in claim 2, wherein the clamp arm is pivoted to the main frame at a location above the tine.

8. The apparatus defined in claim 2, including a subframe supporting the clamp arm, the subframe being at least double a width of the clamp arm and pivoted to the main frame at pivots that are spaced apart at least double the width of the clamp arm.

9. The apparatus defined in claim 2, including an actuator for moving the clamp arm between raised and lowered positions.

10. The apparatus defined in claim 1, wherein the teeth extend parallel the tine when the clamp arm is in a closed position.

11. The apparatus defined in claim 1, wherein the teeth include first teeth on a front half of the clamp arm and include second teeth on a rear half of the clamp arm.

12. The apparatus defined in claim 1, wherein the top clamp arm includes a tip and includes at least one tooth on the tip.

13. The apparatus defined in claim 1, wherein the clamp arm includes a pair of horizontally-spaced parallel side walls.

14. The apparatus defined in claim 1, wherein the clamp arm defines a downwardly-open space sufficient to receive the tine.

15. The apparatus defined in claim 1, wherein the clamp arm is pivoted to the main frame at a location above the tine.

16. The apparatus defined in claim 1, including an actuator for moving the clamp arm between raised and lowered positions.

* * * * *